United States Patent [19]

Falchi

[11] 4,347,415

[45] Aug. 31, 1982

[54] ELECTRIC QUICK-BREAK SWITCH WITH FORCED OPENING OF THE CONTACTS

[75] Inventor: Fiorino Falchi, Sangano, Italy

[73] Assignee: General Electric Company, New York, N.Y.

[21] Appl. No.: 229,476

[22] Filed: Jan. 29, 1981

[30] Foreign Application Priority Data

Feb. 6, 1980 [IT] Italy ..... 19728 A/80

[51] Int. Cl.[3] ..... H01H 3/32

[52] U.S. Cl. ..... 200/154; 200/67 R; 200/67 DB; 200/76; 200/70; 200/243

[58] Field of Search ..... 200/154, 67 R, 67 D, 200/67 DA, 67 DB, 67 G, 68, 70, 243, 76, 67 PK

[56] References Cited

U.S. PATENT DOCUMENTS 3,967,081 6/1976 Portmann et al. ..... 200/76

FOREIGN PATENT DOCUMENTS 795898 10/1968 Canada ..... 200/67 R 1935255 2/1971 Fed. Rep. of Germany ..... 200/76

2228096 12/1973 Fed. Rep. of Germany ..... 200/76

1418117 10/1965 France ..... 200/67 R 1211198 11/1970 United Kingdom ..... 200/67 R

*Primary Examiner*—Willis Little

*Attorney, Agent, or Firm*—Walter C. Bernkopf

[57] ABSTRACT

An electric switch wherein longitudinal depression of a rod in a first direction toggles a spring pivoted on the rod. This snaps a movable contact bridge extending transversely to the rod away from a set of stationary contacts to open normally closed contacts. If the snap action fails to separate the movable bridge from the stationary contacts, a pair of contact levers forces the opening of the normally closed contacts. The inner ends of the levers are pivotally mounted on opposing sides of the rod at locations displaced in the first direction from the spring. Stationary fulcrums on opposite sides of the rod rotate the levers upon displacement of the rod and cause the lugs extending from the outer ends of the rod to engage the movable contact bridge on opposing sides of the rod and to force the bridge to separate.

9 Claims, 7 Drawing Figures

FIG. 1
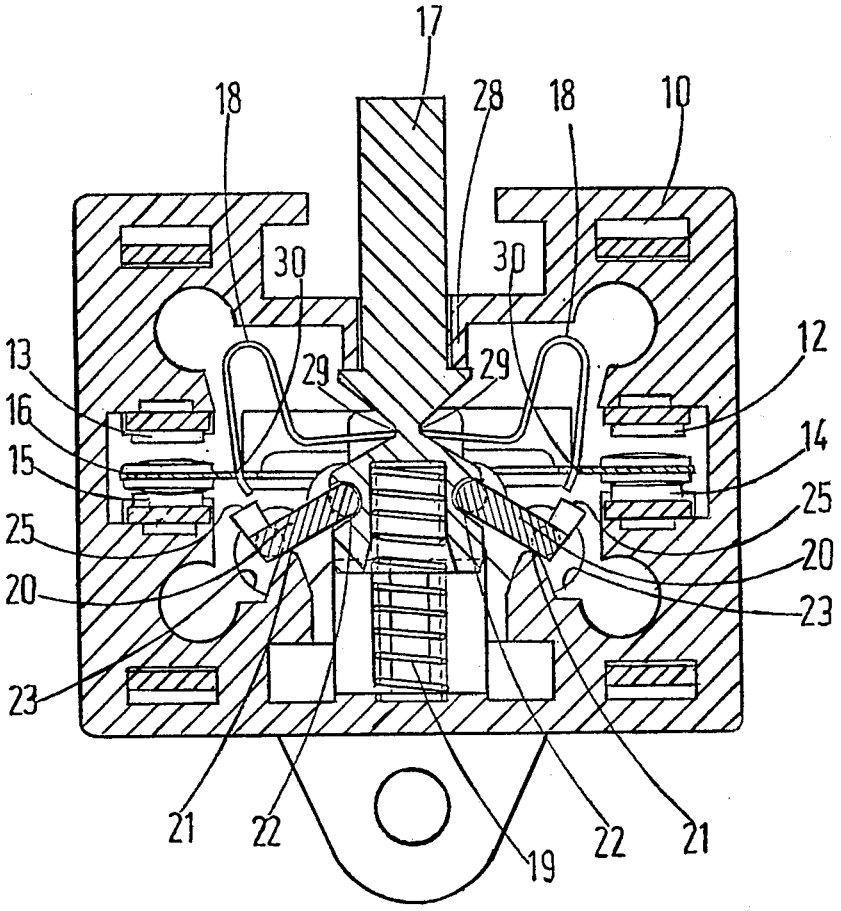
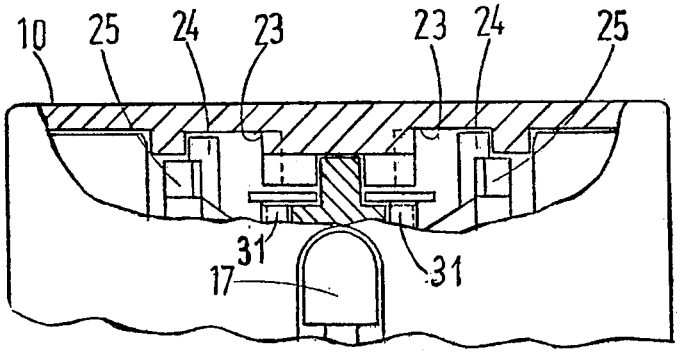
FIG. 2

ELECTRIC QUICK-BREAK SWITCH WITH FORCED OPENING OF THE CONTACTS

BACKGROUND OF THE INVENTION

This invention relates to an electric quick-break switch of a type including supplemental means for forcing the normally closed contacts of the switch to open, in the event they otherwise fail to open upon switch actuation, as for example due to the slight welding together of the contacts.

Quick-break switches are mainly utilized in travel limiting devices, which are largely employed in the fields of sequential operation controls, control of the travel limits of machine tool slides, and the like.

Several national and international standards require that certain systems, such as travel limiting devices, be equipped with a switch devised to ensure that the normally closed contacts are opened even in the event of failures in any part of the switch.

A known technique of ensuring a positive opening of the contacts is that of connecting in series to the normally closed contacts, another pair of contacts, also normally closed, which are opened by an override movement of the quick-break switch actuating members. This approach has the disadvantage of being bulky and expensive.

A further technique, for ensuring a positive opening of the contacts, provides a mechanical means effective to urge the movable portion of the contact pair to open whenever its correct opening by the actuating members fails to occur. This is accomplished in one of two ways. One solution provides a lever of any sort which is supported on the bottom of the switch body and is pushed to one end by a member connected to the switch actuating mechanism as an extension of an actuating button or rod. Such a mechanism, while effective, requires that the switch be arranged in a vertically upright position with the actuating button pointing upwards. The other solution provides two or more levers journaled to the sidewalls of the switch body and having one end acted upon by a cam surface connected to the actuating button, causing the other end to become adapted to strike the movable portion of the contacts, which is accomplished through an additional or override movement of the button. Successful operation is still related to the switch body position. When the switch is positioned with its actuating button pointing downwards, the actuating levers, if not perfectly balanced, may pivot by gravity to rest against the movable portion of the contacts, thus impairing the opening operation accuracy and possibly hindering the free movement of the actuating button itself.

OBJECTS OF THE INVENTION

It is therefore an object of this invention to provide an improved snap action switch with supplemental switch actuating means.

It is another object of this invention to provide a switch having a supplemental forced switch opening device functioning properly irrespective of the physical orientation of the switch assembly.

It is another object of this invention to provide a switch of the type wherein a movable contactor bridge selectively engages either a pair of normally open or a pair of normally closed contacts, having improved forced opening means designed to preclude the bridge from improper simultaneous engagement of contacts of each pair.

It is a further object to provide an improved forced opening assembly of a switch which is resistant to being jammed or wedged.

It is yet a further object to provide an improved forced opening assembly of a switch designed to preclude improper opening of the switch contacts.

Other objects of the invention will be pointed out and understood hereinafter.

SUMMARY OF THE INVENTION

According to one aspect of this invention, a quick-break switch with mechanical forced opening of the contacts is provided, comprising a stationary or fixed part and a movable part, said stationary or fixed part including a body containing in specially provided seats thereof two pairs of fixed contacts, said movable part comprising a rod carrying two quick-release toggle springs pivoted thereto, said toggle springs retaining a movable contact bridge, said movable contact bridge being operative to establish connection with either one of said fixed contact pairs. Under the areas of the rod where the two quick-release toggle springs are pivoted, there are provided lever pivot points, preferably two semicylindrical seats, adapted for receiving, in hinged connection relationship, the inside end of the two levers being slidably supported on fulcrum projections fixed to the switch body, said levers being provided each, at their outer ends, with transverse projections, preferably of circular cross section, adapted for sliding against a curved, preferably cylindrical, seat formed in the switch body. Upon longitudinal displacement of the rod, the outside ends of the levers trace symmetrical arcuate paths with respect to the rod for the purpose that, should the normally closed contacts fail to open for any anomalous cause, the free ends of the two levers impinge on the movable contact bridge to force it to simultaneously disengage from the normally closed contacts so that the latter are opened. The outer ends of the levers preferably have angularly disposed lug members that are utilized to engage the contact bridge. The outer ends of the levers are made to follow two symmetrical arcuate paths to assure, through their action, a simultaneous opening of the normally closed contacts.

BRIEF DESCRIPTION OF THE DRAWING

FIG. 1 is a diagrammatic sectional view of the switch;

FIG. 2 is a fragmentary plan view of the switch shown in FIG. 1;

DESCRIPTION OF A PREFERRED EMBODIMENT

Figure 7:
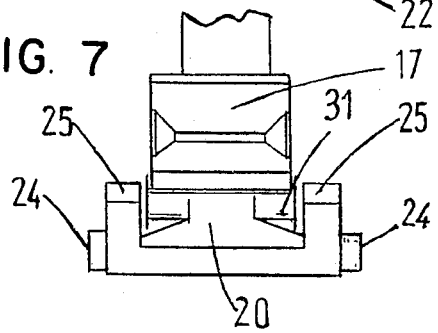
FIG. 7 is a diagrammatic side view of one of the levers which function to produce the forced opening of the contacts.

With reference to FIGS. 1, 2 and 7, the quick-break switch according to this invention comprises a housing 10 of a plastic material, in the form of a box accommodating two pairs of fixed contacts, namely: a pair 12, 13 performing the function of normally open contacts, and a pair 14, 15 performing the function of normally closed contacts. A movable contact bridge 16, comprising a thin metallic member whose ends have opposing contact tips serving as the contact points. The bridge is anchored to button or rod 17, made of a plastic material, which serves as a switch actuator. Anchoring is achieved by means of two quick-release metal toggle springs 18. One end of each spring is seated, respectively, in one of two seats 29 formed on opposing sides of rod 17. The other sides of springs 18 extend against edges 30 of the movable contact bridge 16. The toggle springs, by virtue of their overcenter principle, will effect a rapid displacement of the movable contact bridge 16 through the space included between the two pairs of fixed contacts 12, 13 and 14, 15 to thus open the normally closed contacts and close the normally open ones.

Rod 17 is returned to its original rest or inoperative position by a biasing spring 19 having one end secured in a hollow seat formed in the lower portion of the rod. The other end of the spring is positioned in a seat formed in the housing 10. The spring urges the rod 17 upward to stop against a projection 28 of the housing 10.

The forced opening device comprises two forced opening levers 20 made of a plastic material. The outer end of each lever has lug members 25 extending substantially orthogonally to the main lever arm. Each lever 20 has its inner end hingedly connected to rod 17 such that the levers extend from opposing sidewalls of the rod. The levers are connected at lever pivot points 22 located at the sides of the rod intermediate the spring pivot points, i.e., seats, 29, and the end of the rod adjacent to spring 19. The inner ends of the levers comprise a small cylindrical pin 31 (FIG. 7). The pivot points on the rod comprise two hollow mating seats 22 formed in the rod. Cylindrical projections 24 extend transversely from the outer ends of the levers at the elbow formed by the outer end of the lever arm and lugs 25. Projections 24 extend into cylindrical or arcuate seats 23 located on opposing sides of the housing 10. The seats serve to guide and limit the movement of the two levers. Each lever 20 has two lugs 25 intended for acting on the movable contact bridge 16 such as to perform the forced opening function. The two lugs extend orthogonally upward off lever 20 and are displaced from one another so as to clear the rod (FIG. 7), and to abut against the arms of the contact bridge 16 under the circumstances described below.

FIG. 1 shows the switch in its rest or inoperative condition, that is, with the contact pair 12, 13 open and the contact pair 14, 15 closed. The rod 17 has its upward stroke limited by the projection 28 of the housing 10. In that position the movable contact bridge 16 is positioned to engage and close the fixed contacts 14, 15. This occurs by virtue of the force exerted by the quick-release toggle springs 18 on the movable contact bridge 16, due to the overcenter principle.

The forced opening device comprises the two levers 20 which are hingedly connected to their inner end within the seats 22 of rod 17. The lever arms rest on a raised fulcrum portion 21 of the housing 10 situated adjacent each side of rod 17. The fulcrum portion 21 functions as a pivot center for the forced separation of the movable contact bridge 16. Stationary guide means comprising cylindrical seats 23 are positioned on the sidewalls of housing 10 adjacent to the outer end of each lever 20. Movement of levers and thus of the lever projections 25 is guided and limited by seats 23 to perform dual functions. The two levers are prevented from applying their weight to the movable contact bridge 16 when the switch is arranged vertically with the operating button 17 facing downwards. The guide means also prevents the two levers from wedging themselves between the movable contact bridge 16 and seats 29, the spring pivot points, during operation of the operating button 17. This prevents wedging, and the resulting danger of jamming and damaging the switch.

The operation of the forced opening device is illustrated sequentially in FIGS. 3, 4, 5 and 6.

Figure 3:
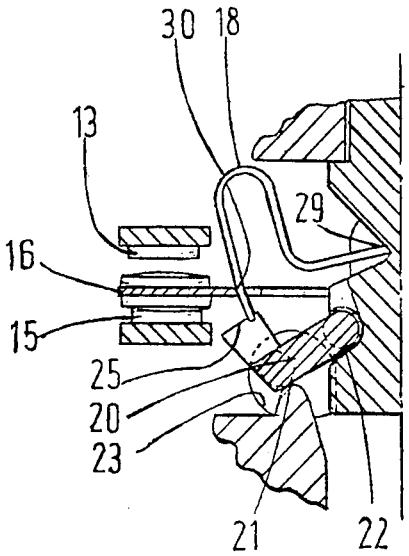
FIGS. 3, 4, 5 and 6 illustrate schematically the operation phases of the forced opening device.

FIG. 3 illustrates the normal position of operating button, i.e., rod, 17 and its associated components. The movable contact bridge 16 extends orthogonally to the rod with its lower contact tips engaging the lower pair of stationary contacts 14 and 15. Levers 20 are pivoted down because the lever point points on rod 17 are higher than the raised fulcrum portion 21. The cylindrical guide means 23 prevent the lever arms from interfering with movable contact bridge 16.

Figure 4:
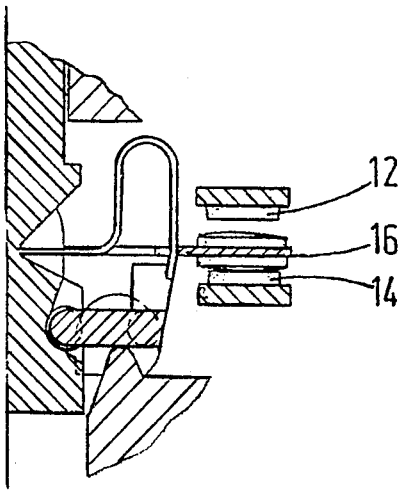
Figure 5:
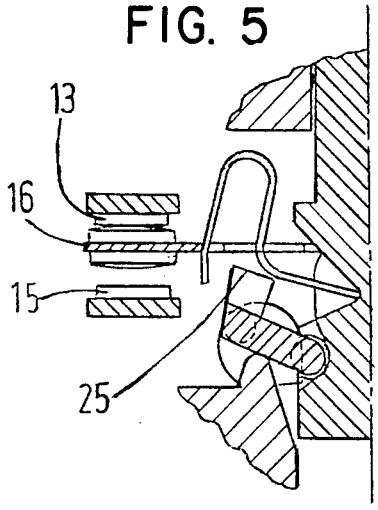

Assume that a downward directed force is appliedto the end of the operating button that protrudes from the switch, so that rod 17 is displaced downward from its normal position. FIG. 4 illustrates the initial, i.e. partial, displacement of the rod. The movable contact bridge initially remains stationary. The levers 20 have been pushed up by fulcrum portions 21 to a substantially horizontal position because the lever pivot points on rod 17 have descended in respect to the stationary fulcrum 21. Additional downward movement of rod 17 is illustrated in FIG. 5. The spring pivot points on rod 17 have now descended below an imaginary line extending through the former position of the fulcrum points 30, i.e. the pivot points of the toggle springs 18 and the movable contact bridge 16. The resultant reversal of the direction of force exerted by toggle springs on the movable contact bridge caused the latter to snap from its former, lower, position to its upper position. Thus, the bridge has disengaged from, and opened, the lower pair of fixed contacts 14 and 15 and has engaged with and closed the upper pair of contacts 12 and 13. The levers 20 have pivoted further upward, above the horizontal, because of the additional downward displacement of the lever pivot points of rod 17 in respect to fulcrum 21 such that the top surfaces of lever projections 25 extend above the plane previously assumed by movable contact bridge 16. Thus, if for some reason, the bridge failed to disengage from stationary contacts 14 and 15, the projections 25 of the levers would engage the bridge in both sides of rod 17 and force it to separate.

Figure 6:
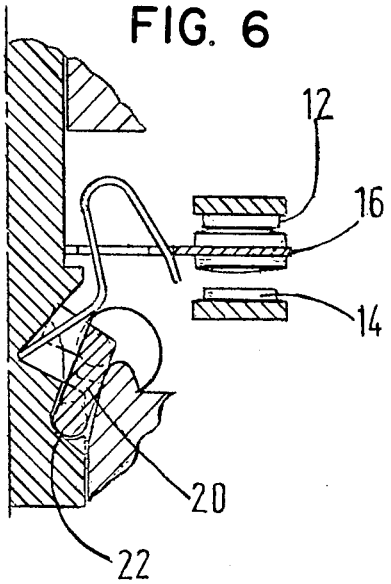

Displacement of rod 17 stops when the bottom of rod 17 engages the bottom wall of housing 10. At such time, further descent of the rod results in maximum permissible upward rotation of levers 20, as illustrated in FIG. 6. As illustrated, the outer ends of the lever arms are prevented by the stationary guide means from coming within the outlines of rod 17 and thus are pervented from wedging into the spring pivot notches on the rod. Since the projections 25 of the lever are laterally displaced from the rod, jamming of the switch is prevented. As described, longitudinal motion of the rod causes the lever projections to travel in a curved path guided by cylindrical projection 23 which prevents improper displacement of the lever.

Although the invention has been described with reference to a specific embodiment thereof, numerous modifications thereof are possible without departing from the invention and it is desirable to cover all modifications falling within the spirit and scope of this invention.

What I claim as new and desire to secure by Letters Patent of the United States is:

1. A snap action electric switch with supplemental means for opening normally closed switch contacts, comprising:

(a) a stationary housing;

(b) a longitudinally movable rod extending within said housing;

(c) at least a pair of stationary contacts fixed in said housing on opposing sides of said rod;

(d) a movable contact bridge extending about said rod;

(e) spring pivot points located on said rod;

(f) snap action springs extending from opposing sides of said contact bridge to said spring pivot points so that when the rod is in a first position the contact bridge engages said pair of stationary contacts and upon movement of the rod in a first direction, the contact bridge snaps in an opposite direction to disengage from the pair of stationary contacts;

(g) first and second levers each comprising an inner and an outer end;

(h) means for hinging the inner ends of said levers on opposing sides of the rod at lever pivot points displaced in the first direction from the spring pivot points;

(i) stationary fulcrum means positioned on opposing sides of the rod to engage and rotate said levers upon displacement of the rod;

(j) said levers being formed so that in the event the snap action springs fail to disengage the contact bridge from the pair of fixed contacts upon displacement of the rod, the levers engage the contact bridge on opposing sides of the rod and force such disengagement; and (k) stationary guide means cooperating with said levers to control displacement of the levers to prevent the levers from disengaging the contact bridge from said pair of stationary contacts when said rod is in the predetermined position.

2. The switch of claim 1 wherein the outer end of said levers comprise angularly displaced members positioned to engage the contact bridge in the event the bridge is not disengaged upon displacement of the rod.

3. The switch of claim 2 wherein said stationary guide means comprises curved wall members in the sidewall of the stationary housing and the outer ends of the levers comprise transversely extending protrusions adapted for sliding engagement with the curved seating walls to limit the rotation of the levers.

4. The arrangement of claim 3 wherein the curved seating walls are of circular configuration and the protrusions are of circular cross-section and are positioned for sliding engagement within the seating walls to provide for circular displacement of the outer ends of the levers.

5. The arrangement of any of claims 2, 3, or 4 wherein said angularly displaced members comprise a plurality of lugs transversely displaced from one another so as to be external of the transverse dimensions of the rod to prevent interference of the lugs with the snap action springs and the spring pivot points on the rod.

6. The arrangement of claim 4 wherein said switch comprises a second pair of stationary contacts fixed on said housing so that said movable contact bridge extends intermediate said first and second pair of stationary contacts and movement of the rod in the first direction results in said movable contact bridge engaging said second pair of stationary contacts.

7. In an electric snap action switch having supplemental means for opening normally closed contacts wherein a first and a second pair of fixed contacts are secured to a stationary housing, a longitudinally movable rod has spring pivot points for retaining quick release toggle springs for retaining a movable contact bridge positioned intermediate the first and the second pair of fixed contacts, the contact bridge being adapted to disengage from the first pair of contacts and to engage the second pair of contacts upon movement of the rod in a first direction, the combination comprising;

(a) semicylindrical seats disposed on opposing sides of the rod and longitudinally displaced in the first direction from the spring pivot points;

(b) first and second levers each comprising an inner and an outer end, the inner end of each lever being pivotally accommodated by one of said semicylindrical seats;

(c) a plurality of lugs angularly extending from the outer ends of said levers;

(d) fulcrum means integral with the stationary housing arranged for sliding engagement with said first and second levers so that movement of the rod in the first direction causes the lugs to move circularly to engage and displace the movable contact bridge from the first pair of contacts in the event such disengagement was not produced by the quick release toggle springs;

(e) curved seating walls formed in the stationary housing; and (f) cylindrical projections extending transversely from the outer ends of said levers and adapted for sliding engagement with the curved seating walls to prevent undesirable movement of said levers.

8. The electric switch of claim 6, wherein said curved seating walls are of circular configuration and said cylindrical projections are adapted for sliding engagement with the interior of the seating walls.

9. The electric switch of claim 7 wherein the lugs positioned on the outer ends of the levers are transversely displaced from one another to clear the rod when the rod reaches its end of travel in the first direction whereby interference is prevented between the lugs and the spring pivot points of the rod.

* * * * *